US006983725B2

(12) United States Patent
Persson

(10) Patent No.: US 6,983,725 B2
(45) Date of Patent: Jan. 10, 2006

(54) EXHAUST VALVE MECHANISM IN INTERNAL COMBUSTION ENGINES

(75) Inventor: Per Persson, Partille (SE)

(73) Assignee: Volvo Lastvagnar AB, Gothenburg (SE)

( * ) Notice: Subject to any disclaimer, the term of this patent is extended or adjusted under 35 U.S.C. 154(b) by 0 days.

(21) Appl. No.: 10/490,311

(22) PCT Filed: Oct. 10, 2002

(86) PCT No.: PCT/SE02/01849

§ 371 (c)(1),
(2), (4) Date: Mar. 19, 2004

(87) PCT Pub. No.: WO03/031778

PCT Pub. Date: Apr. 17, 2003

(65) Prior Publication Data

US 2004/0237932 A1 Dec. 2, 2004

(30) Foreign Application Priority Data

Oct. 11, 2001 (SE) ..... 0103388

(51) Int. Cl.
*F01L 13/06* (2006.01)
*F02D 13/04* (2006.01)

(52) U.S. Cl. ..... 123/90.16; 123/90.39; 123/321

(58) Field of Classification Search ..... 123/90.15, 123/90.16, 90.17, 90.39, 90.4, 90.46, 321, 123/322
See application file for complete search history.

(56) References Cited

U.S. PATENT DOCUMENTS

| | | | | |
|---|---|---|---|---|
| 4,793,307 | A | 12/1988 | Quenneville et al. | 123/323 |
| 4,911,124 | A | 3/1990 | Bennett | 123/321 |
| 6,257,201 | B1 | 7/2001 | Kajiura et al. | 123/321 |
| 6,354,254 | B1 | 3/2002 | Usko | 123/90.16 |

FOREIGN PATENT DOCUMENTS

| | | |
|---|---|---|
| EP | 0294682 | 12/1988 |
| WO | WO 0061930 | 10/2000 |

*Primary Examiner*—Tony M. Argenbright
(74) *Attorney, Agent, or Firm*—Young & Thompson

(57) ABSTRACT

Valve mechanism in an internal combustion engine, includes a valve play-take up mechanism in the form of a piston in a cylinder chamber at one end of an exhaust rocker arm, and a hydraulic circuit with valve elements for supplying or draining off pressure fluid to and from the cylinder chamber. A second cylinder chamber with a piston acting in an opposite direction is arranged in the rocker arm and communicates with the first-mentioned cylinder chamber. A brake rocker arm is mounted on the same rocker arm shaft as the exhaust rocker arm and has an outer end, which acts against the piston in the second cylinder chamber. The brake rocker arm has its own cam element with brake cam lobes to one side of the exhaust rocker arm cam element.

12 Claims, 6 Drawing Sheets

EXHAUST VALVE MECHANISM IN INTERNAL COMBUSTION ENGINES

FIELD OF THE INVENTION

An exhaust valve mechanism in an internal combustion engine, comprising at least one exhaust valve in each cylinder, a rocker arm shaft-mounted rocker arm for each cylinder for operating the exhaust valve, a cam shaft with a cam element for each rocker arm, said cam element cooperating with motion transmitting means at one end of the rocker arm, a first piston-cylinder device disposed between an opposite end of the rocker arm and the exhaust valve, said first piston-cylinder device having a first cylinder chamber in said opposite rocker arm end, a hydraulic circuit for supplying and draining off pressure fluid to and from said cylinder chamber, and a piston disposed in said cylinder chamber, said piston being biased towards the exhaust valve when pressure fluid is supplied to the cylinder chamber.

BACKROUND OF THE INVENTION

SE-A-468 132 describes an exhaust valve mechanism of the above mentioned type which, together with a special type of camshaft with exhaust cams with extra lobes can be used to increase the engine braking power. The extra cam lobes are dimensioned so that their lifting height corresponds to the normal valve play of the valve mechanism. By reducing, by means of the piston cylinder device, the valve plate to zero, one or more extra lifts of the exhaust valve corresponding to the normal valve play can be achieved during a suitable time interval. For example, an extra cam lobe can be placed in relation to the regular cam lobe so as to provide an extra exhaust valve lift during a later part of the compression stroke, resulting in a loss of a portion of the compression work during the compression stroke which will not be recovered during the expansion stroke. This increases the braking effect of the engine.

In an engine with such an arrangement, the maximum lift height of the exhaust valve during the compression when engine braking, is limited to the valve play. Furthermore, the overlap of the exhaust valve and the intake valve in braking mode increases by virtue of the fact that the maximum lift height of the exhaust valve increases by a distance corresponding to the valve play as compared to drive mode. Since the pressure in the exhaust manifold is much higher than the pressure in the intake manifold in braking mode (ca 5 bar on the exhaust side as opposed to ca 1 bar on the intake side), hot exhaust in an amount depending on the overlap will flow between the exhaust side and the intake side during braking mode, which will impair the engine cooling during braking mode as compared to driving mode, especially since fuel as a cooling medium for the injection nozzle is not available during braking mode. Finally, the exhaust rocker arm must be dimensioned more robustly for braking mode than for normal driving mode, since the opening force on the exhaust valve in braking mode must overcome the force from a high compression pressure in the cylinder, this force being substantially higher than the force on the valve required for normal opening during the exhaust stroke.

OBJECTS OF THE INVENTION

One purpose of the present invention is to achieve an exhaust valve mechanism of the type described by way of introduction which is constructed so that extra lifting of the exhaust valve during braking mode can be effected without affecting the regular lifting of the exhaust valve, to thereby avoid increasing the overlap between the exhaust valve and the intake valve with accompanying large back-flow and reduction of the mass-flow through the engine.

Another purpose of the invention is to achieve an exhaust valve mechanism, where the lifting height of the extra lift of the exhaust valve during braking mode is not limited to the valve play.

An additional purpose of the invention is to achieve an exhaust valve device, in which the exhaust rocker am does not need to be dimensioned for braking mode but only for driving mode.

SUMMARY OF THE INVENTION

This is achieved according to the invention by virtue of the fact that the rocker arm is provided with a second piston-cylinder device on the same side of the rocker arm shaft as the first piston-cylinder device, said second piston-cylinder device having a second cylinder chamber communicating with the first cylinder chamber and housing a second piston which, upon supply of pressure fluid to the second cylinder chamber, is biased in a direction from the exhaust valve, and that a second rocker arm mounted on a rocker arm shaft has an end acting against the second piston and an opposite end with motion-transmitting means, which cooperate with a cam element on a cam shaft.

The invention is based on the idea of using two separate rocker arms, one for exhaust valve lifting during regular driving mode and one for exhaust valve lifting in braking mode. The regular exhaust rocker arm can have a normal lever ratio on the order of 1:1,4–1,6 and need only be dimensioned for the forces occurring during driving mode. The exhaust valve rocker arm for braking mode transmits the valve movement from a separate cam element, whereby the extra cam lobes on the cam elements for regular drive mode can be eliminated. The rocker arm for braking mode acts on the second piston which functions as a pump piston and pumps fluid to the first cylinder chamber. The pressure in the first cylinder chamber presses the first piston towards the exhaust valve. The valve movement during braking mode is thus transmitted partially hydraulically. The second exhaust rocker arm can have another lever ratio than the first exhaust rocker arm, e.g. 1:0,7–1,1, which reduces the forces and the contact pressure in the mechanism. The cam element cooperating with the second rocker arm can have a greater base diameter than the cam element of the first rocker arm, which reduces the contact pressure and/or offers more rapid upward or downward movement.

Through the invention it is possible to eliminate the large valve overlap which is necessary when extra cam lobes are used in the regulate cam element for braking mode, because a high and long ramp is not required to conceal the extra lobes during driving mode. The return flow of exhaust into the cylinder and on through the inlet port, caused by overpressure in the exhaust manifold, is thereby reduced.

BRIEF DESCRIPTION OF THE DRAWINGS

The invention will be described in more detail below with reference to examples shown in the accompanying drawings, where.

DETAILED DESCRIPTION OF THE INVENTION

Figure 1:
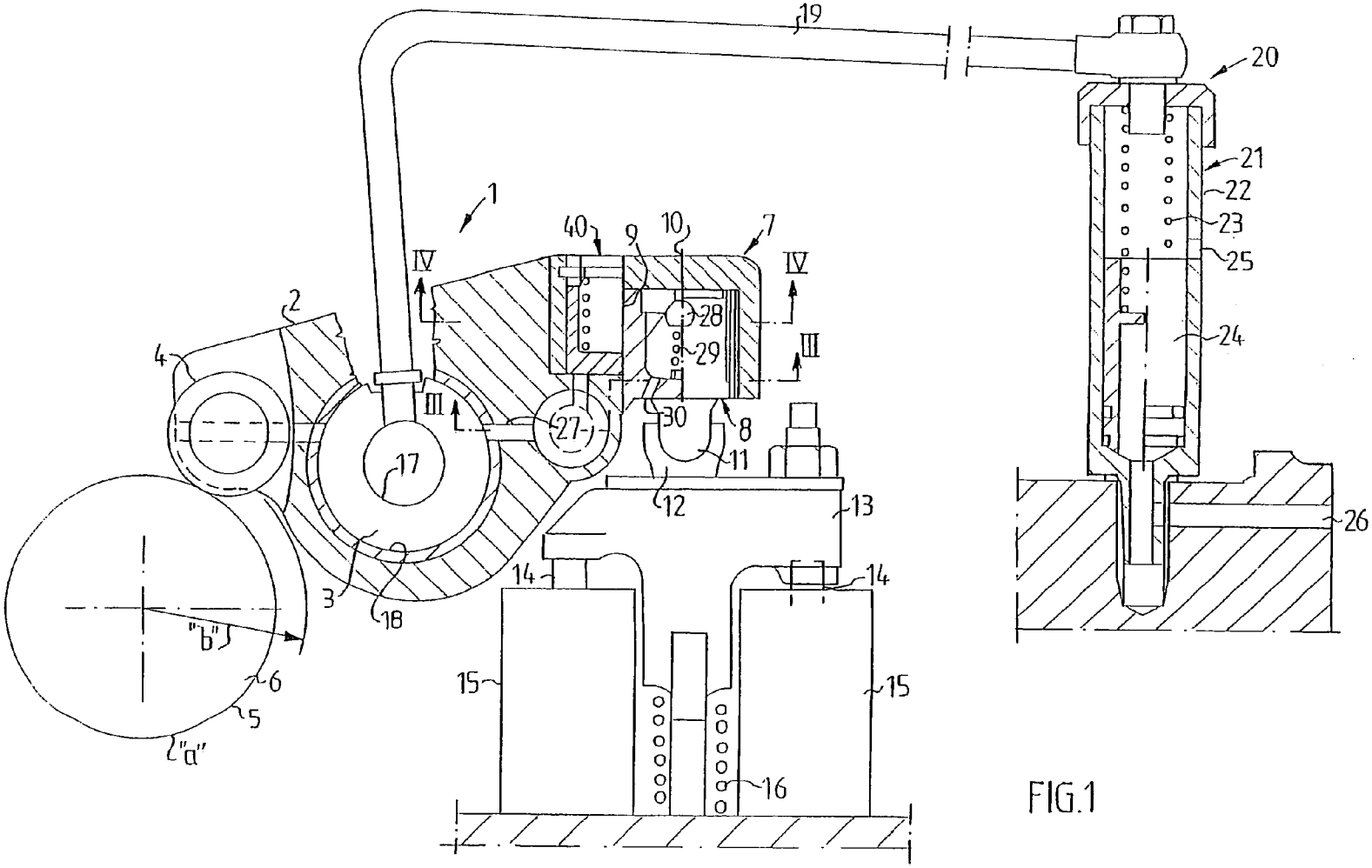
FIG. 1 shows a side view of one embodiment of an exhaust valve mechanism according to the invention with a longitudinal section through the exhaust valve rocker arm for regular valve lifting during driving mode but without the rocker arm for braking mode.

FIG. 1 shows schematically a valve mechanism 1 in an internal combustion engine (not shown). The mechanism 1 comprises an exhaust valve rocker arm 2, which is rockably mounted on a rocker arm shaft 3. One end of the rocker arm 2 has a cam follower roller 4, rotatably mounted thereon. The cam follower roller 4 is in contact with a schematically shown cam element 5 on the camshaft 6. The designation "a" indicates the base circle of the cam element 5, and "b" designates its top radius. At its end 7 opposite to the end with the cam follower roller 4, the rocker arm 2 is provided with a piston cylinder device 8 consisting of a cylinder chamber 9 formed in the rocker arm end 7 and a piston 10 housed in the cylinder chamber. The piston 10 is provided with a piston pin 11 with a spherical end extending into a socket 12 on a yoke 13 which, during operation, applies pressure to two exhaust valve spindles 14. 15 designates two valve springs for closing the valves. Beyond the springs 15 there is an additional spring 16, which is designed to keep the yoke 13 in such a position that the play, which is always present in a valve mechanism of this type, is disposed between the ends 14 of the spindles and the underside of the yoke 13.

The valve mechanism 1 described is lubricated by pressurized oil which is supplied by the engine oil pump via channels in the engine block and the cylinder head (not shown) to a channel 17 in the rocker arm shaft 3. The rocker arm 2 has journal bearings 18, which are lubricated by a minor leakage flow between the shaft 3 and the bearing 18. The excess oil is returned via a return line 19, in a hydraulic circuit generally designated 20, which contains a valve device 21 consisting of a valve housing 22 and a valve element 24 biased by a spring 23. The housing 22 has an outlet 25 through which return oil flows back to the engine oil sump, when the valve element is in the position shown in FIG. 1. The housing 22 also has an inlet 26 for a pressure medium (compressed air or hydraulic fluid). When pressure medium is supplied through the inlet 26, the valve element 24 is biased upwards in FIG. 1, thereby closing the outlet 25 and blocking the return flow through the line 19. The result will be that the pressure in the channel 17 rises. The channel 17 communicates via a channel 27 with the cylinder chamber 9 above the piston 10, which leads to the piston being loaded downwards towards the valve yoke 13 so that the play between the yoke and the upper end surfaces of the valve spindles is adjusted down to zero. In the piston 10 there is a relief valve, which limits the pressure to a predetermined level. If this level is exceeded, the valve 28, 29 opens so that oil can drain out through channels 30 in the piston.

Figure 3:
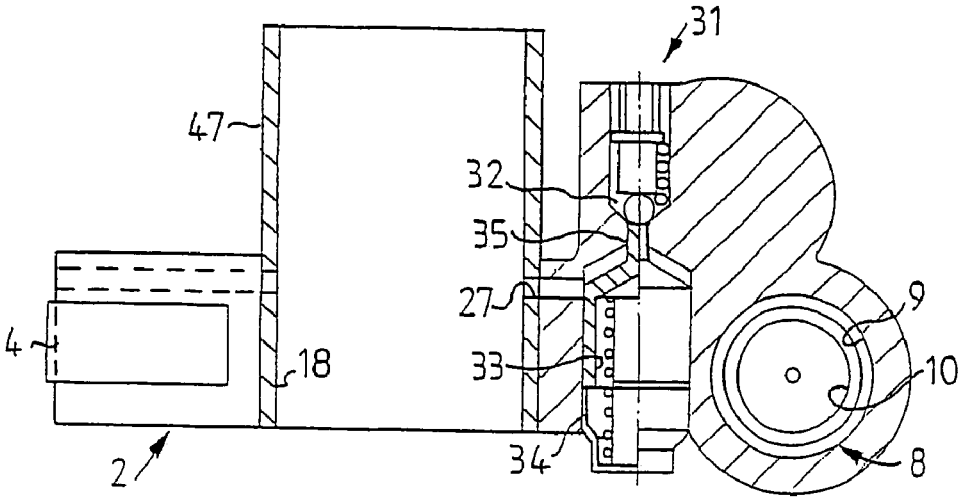
FIG. 3 shows a section through the rocker arm in FIG. 1 along the line III—III.

In order to prevent the pumping of oil between the cylinder chamber 9 and the chamber 17 in the rocker arm shaft during operation with zero valve play, a one-way valve 31 (FIG. 3) is arranged in the rocker arm channel 27. The one-way valve 31 comprises a valve element 32 in the form of a ball which, when there is high pressure in the hydraulic circuit, is held in its closed position by the pressure in the cylinder chamber 9 and by a spring. The pressure in the hydraulic circuit acts also against the end of a piston 34 biased by a spring 33. The piston 34 has a shaft 35 extending to the seat of the ball 32. When there is high pressure in the circuit, i.e. when the valve 21 is closed, the pressure will keep the piston 34 in a position with the end of the shaft 35 at a distance from the ball 32, thereby keeping the valve closed. When the valve 21 opens the return line 19, the oil pressure drops and when the force on the piston caused by the oil pressure exceeds the force from the spring 33, the shaft 35 will push the ball 32 away so that the valve opens and the cylinder chamber 9 is put in communication with the return line 19.

The features hitherto described with reference to FIG. 1 are background art.

Figure 2:
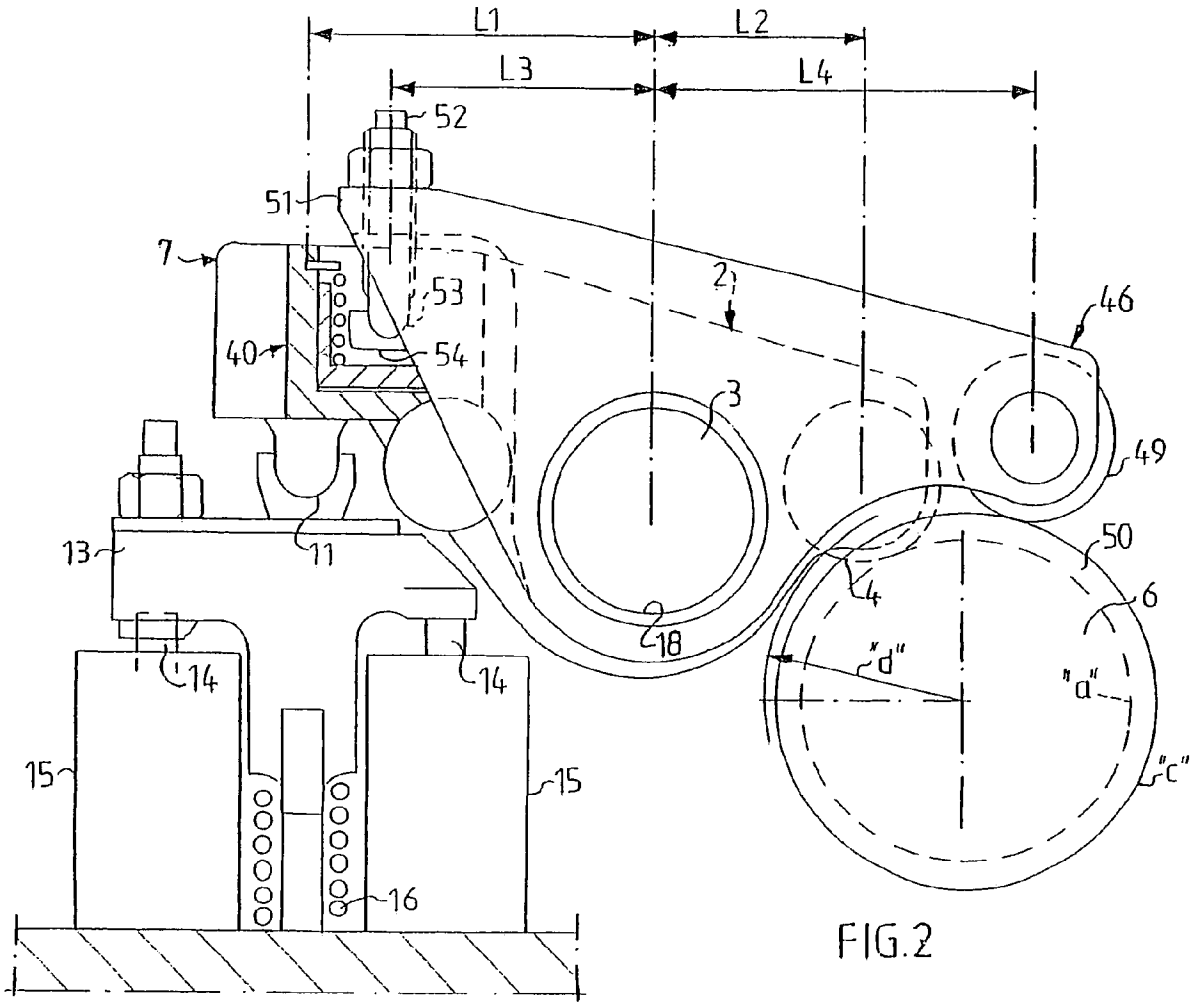
FIG. 2 shows a side view, mirror reversed in relation to FIG. 1, of the valve mechanism according to the invention with the rocker arm for braking mode and with the rocker arm for regular valve lift partially in section.

According to the present invention, the exhaust rocker arm 2 is made with a second piston cylinder device 40 comprising a cylinder chamber 41 spaced from the rocker arm end 7 and a piston 42 disposed in the cylinder chamber. As can be seen in the figures, the cylinder chamber 41 is essentially directed opposite to the cylinder chamber 9, i.e. it opens upwards as seen in FIGS. 1 and 2 and communicates with the first cylinder chamber via a channel 48. As is particularly evident from FIG. 2, the piston 42 is concave as is the piston 10. Between the bottom 43 of the depression in the piston 42 and a lock ring 44, a helical spring 45 is tensioned, thereby loading the piston 42 towards the bottom of the cylinder chamber 41. A second exhaust rocker arm 46 is mounted on a laterally extending portion 47 of the bearing bushing 18 non-rotatably joined to the first exhaust rocker arm 2 (see FIGS. 3 and 4). At one end of the second rocker arm 46 there is a cam follower roller 49 rotatably mounted. The cam follower roller 49 is in contact with a schematically shown cam element 50 on the camshaft 6. "c" designates the base circle of the cam element and "d" its top radius. At its opposite end designated 51 an adjustable spindle 52 is screwed in, which extends into the depression of the piston 42 and has a spherical end 53 held in a corresponding depression in a guide 54.

Figure 4:
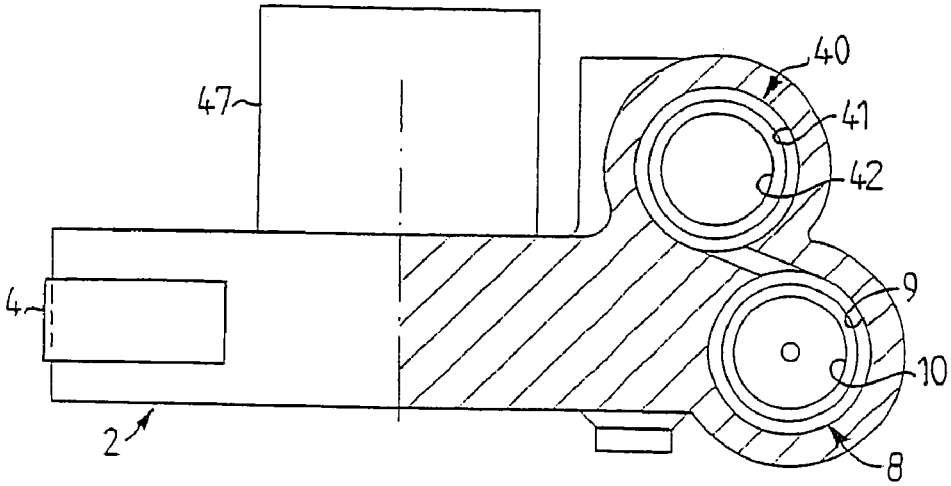
FIG. 4 shows a section through the rocker arm in FIG. 1 along the line IV—IV.

As is particularly evident from FIG. 4, in the example shown the cylinder chamber 41 has the same cross-sectional area as the cylinder chamber 9, which means that a pump stroke with a certain stroke length of the piston 42 results in the same stroke length in the piston 10. Other embodiments with different cross-sectional areas for the cylinder chambers 9 and 41 are conceivable, but the stroke lengths for the pistons 10 and 42 will then be inversely proportional to their cross-sectional areas. The reactive forces, which can be different, from the two cylinder chambers 9 and 41, form together with the lever lengths L1 and L3 a resulting reactive torque in the rocker arm 2. The mechanical advantage of the rocker arms 2 and 46 differ however, firstly, by virtue of the fact that the cylinder chambers 9, 41 are placed at different distances from the rocker arm shaft 2 and, secondly, by virtue of the fact that the cam follower rollers 4 and 49 are mounted on their respective rocker arms at different distances from the rotational axis of the rocker arm. In the example shown in FIG. 2, the ratio L2/L1 of the exhaust rocker arm 2 is ca 1:1.6, while the ratio L4/L3 of the exhaust rocker arm 46 is ca 1:0.7. A suitable interval for the mechanical advantage of the rocker arm 2 can be ca 1:1.1–1.6 and for the mechanical advantage of the rocker arm 46 ca 1:0.7–1.1.

In normal drive mode operation, the valve 21 is open and the pistons 10 and 42 lie in their end positions shown in FIGS. 1 and 2. The transition to braking mode is effected by closing the valve 21 so that the pressure is built up in the hydraulic circuit 20. The piston 10 is thereby displaced downwards to adjust the valve play to zero at the same time as the piston 42 is displaced upwards to an upper end position abutting against the lock ring 44. The brake cam element 50 can be provided with, for example, one or two (not shown) cam lobes with the top radius "d" shown in FIG. 2, either only one for opening the exhaust valve 14 at the end of the compression stroke (the decompression) or one for opening the exhaust valve 14 at the last portion of the intake stroke (the charging) and one for opening the exhaust valve 14 at the end of the compression stroke (the decompression). During the angular interval, when first the first and then the second of these brake cam lobes strikes the cam follower roller 49 of the rocker arm 46 and the rocker arm 46 thereby presses against the piston 42 so that oil is pumped into the cylinder chamber 9 behind the piston 10 to press it down and open the exhaust valve, the cam follower roller 4 of the regular exhaust rocker arm 2 lies on the base circle "a" of the cam element 5. By virtue of the above described difference in the leverage of the two rocker arms 2 and 46, there will be a limited reactive torque in the regular rocker arm 2, which is continually taken up by its cam follower roller 4 on the base circle "a" of the cam element 5 during charging and decompression. The regular exhaust rocker arm 2 thus does not move on its own during the charging and decompression, which is advantageous for the bearing bushing 18 since it cannot be subjected to load on one edge. The design results in the two rocker arms 2 and 46 together taking up the loads during the charging and decompression sequence, even if the extra exhaust valve rocker arm 46, for brake mode operation, has to absorb the major part of the load and perform the work of opening the exhaust valves.

Figure 5:
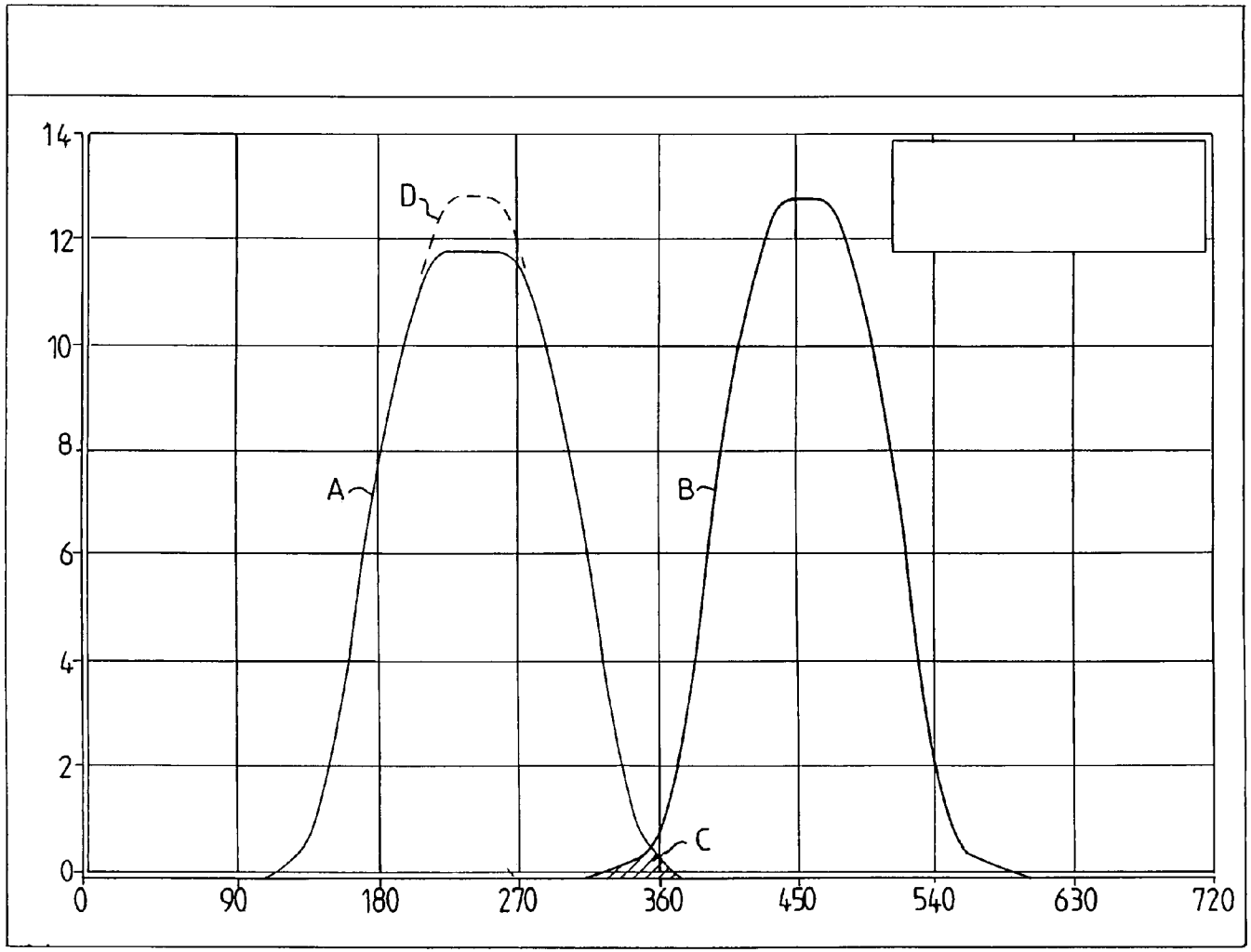
FIG. 5 is a diagram illustrating the lifting curves of the exhaust valve and of the intake valve in normal driving mode.
Figure 6:
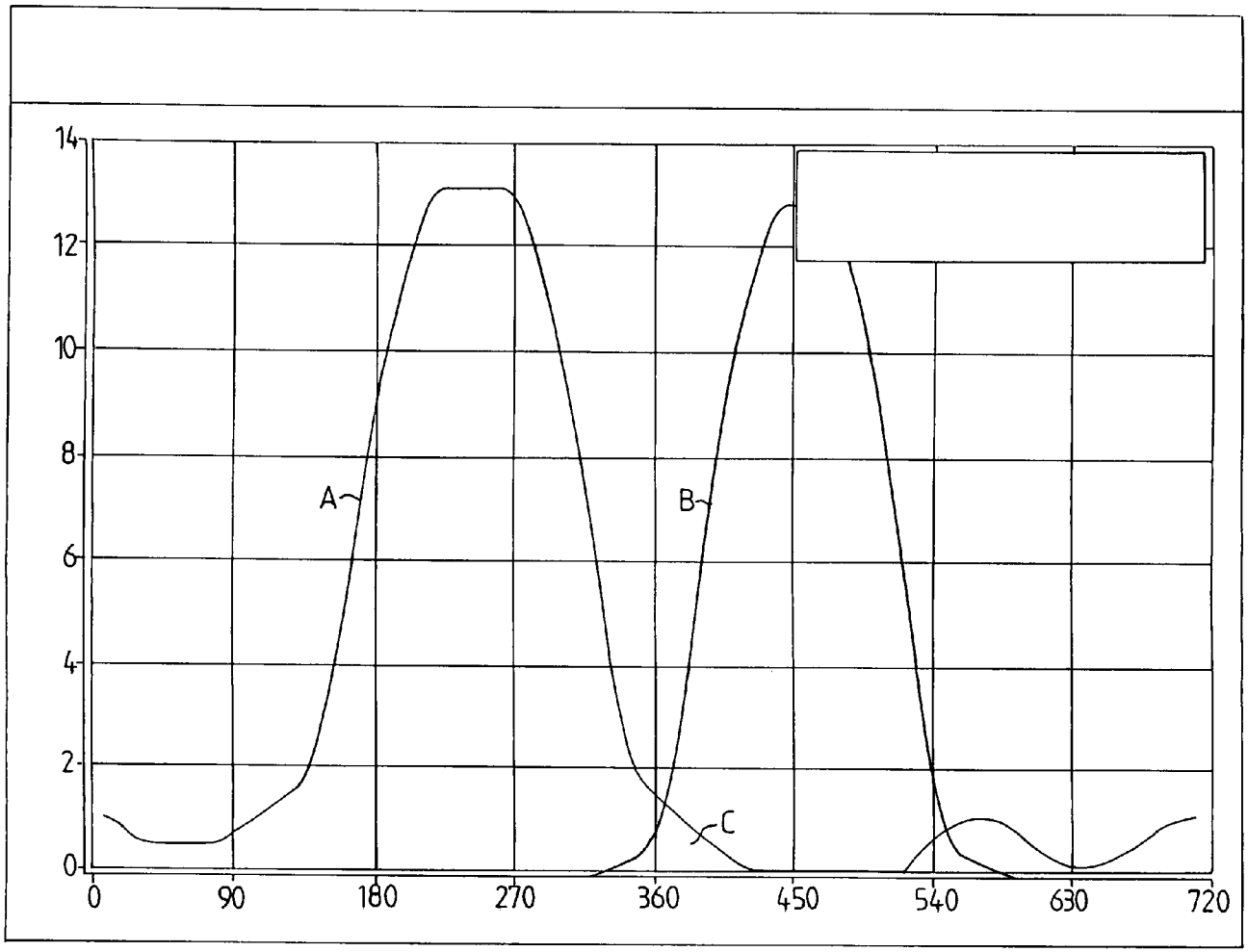
FIG. 6 is a corresponding diagram during braking mode with the described previously known exhaust valve mechanism.

The diagram of FIG. 5 shows the lift curve A of the exhaust valve and the lift curve B of the intake valve during normal drive mode operation. As can be seen by the shaded area C, the valve overlap is relatively small. The dashed line D illustrates the increase in exhaust valve lift when going from driving mode to braking mode by adjusting down the valve play to zero and using the described previously known technology with extra cam lobes on the regular cam. As is evident from the diagram in FIG. 6, showing the lift curves A and B during braking mode while using the described known technology, the valve overlap C increases markedly as compared to driving mode. This in turn leads to, as mentioned above, a relatively significant back-flow from the exhaust side to the intake side.

Figure 7:
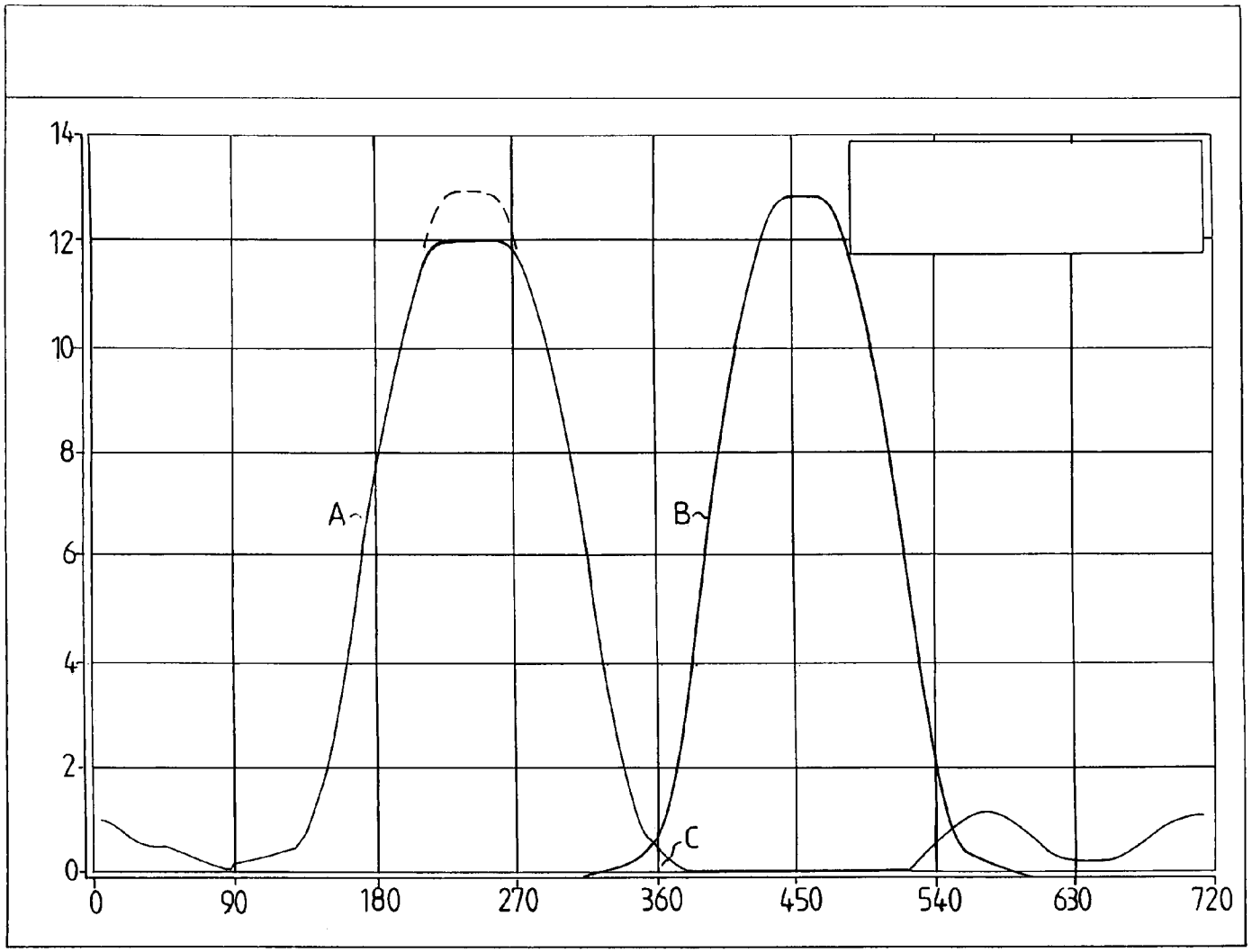
FIG. 7 is a corresponding diagram during braking mode with the valve mechanism according to the present invention.

The diagram in FIG. 7 shows the lift curve A of the exhaust valve and the lift curve B of the intake valve during braking mode, using a valve mechanism 1 according to the present invention. As can be seen by a comparison with FIG. 5, in this case there is no change in the regular lift curve A of the exhaust valve when changing from drive mode to brake mode and, consequently, the valve overlap C does not change, as can be seen by comparison.

The diagrams in FIGS. 6 and 7 reveal, when compared, that the extra lifts A1, A2 during brake mode are of equal height. The lifting height when using the described known technology is limited to the valve play, in practice at most ca 1 mm. The lift height when using the valve mechanism according to the invention is limited to what the space between the valve disc and the top of the piston permit, when the piston is in its uppermost position, and can be appreciably higher than that shown. Furthermore, the valve mechanism according to the invention can absorb greater forces than the previously known valve mechanism, which means that a higher differential pressure can be permitted over the exhaust valve, ca 70 bar as compared to ca 45 bar previously. With 5 bar of counter-pressure in the exhaust manifold, this means that the compression pressure can be allowed to be raised from ca 50 bar to ca 75 bar, which corresponds to an increase in the braking power by ca 30%.

The invention claimed is:

1. Exhaust valve mechanism in an internal combustion engine, comprising at least one exhaust valve (14) in each cylinder, a rocker arm shaft (3)-mounted rocker arm (2) for each cylinder for operating the exhaust valve, a cam shaft (6) with a cam element (5) for each rocker arm, said cam element cooperating with motion transmitting means (4) at one end of the rocker arm, a first piston-cylinder device (8) disposed between an opposite end of the rocker arm and the exhaust valve, said first piston-cylinder device (8) having a first cylinder chamber (9) in said opposite rocker arm end, a hydraulic circuit (20) for supplying and draining off pressure fluid to and from said cylinder chamber, and a piston (10) disposed in said cylinder chamber, said piston (10) being biased towards the exhaust valve when pressure fluid is supplied to the cylinder chamber, characterized in that the rocker arm (2) is provided with a second piston-cylinder device (40) on the same side of the rocker arm shaft as the first piston-cylinder device (8), said second piston-cylinder device (40) having a second cylinder chamber (41) communicating with the first cylinder chamber and housing a second piston (42) which, upon supply of pressure fluid to the second cylinder chamber, is biased in a direction from the exhaust valve, and that a second rocker arm (46) mounted on a rocker arm shaft has an end (53) acting against the second piston and an opposite end with motion-transmitting means (49), which cooperate with a cam element (50) on a cam shaft (6).

2. Valve mechanism according to claim 1, characterized in that the second rocker arm (46) is mounted laterally in relation to and on the same rocker arm shaft (3) as the first mentioned rocker arm (2).

3. Valve mechanism according to claim 2, characterized in that the motion-transmitting means of the second rocker arm is a cam follower (49), which cooperates with a cam element (50) laterally spaced from and on the same cam shaft (6) as the cam element (5) of the first-mentioned cam shaft.

4. Valve mechanism according to claim 1, characterized in that the second cylinder chamber (4) is disposed at a smaller distance from the rocker arm shaft (3) than the first cylinder chamber (9).

5. Valve mechanism according to claim 1, characterized in that the second piston-cylinder device (40) is displaced in the rocker arm axial direction in relation to the first piston-cylinder device (8).

6. Valve mechanism according to claim 4, characterized in that the first rocker arm (2) has a leverage ratio on the order of 1:1.4–1.6, while the second rocker arm (46) has a leverage ratio on the order of 1:1.7–1.1.

7. Valve mechanism according to claim 1, characterized in that the first rocker arm (2) is mounted on the rocker arm shaft (3) via a bushing (18) non-rotatably joined to the first rocker arm, and having a portion (47) extending in a direction towards the second rocker arm, the second rocker arm (46) being journalled on said portion (47).

8. Valve mechanism according to claim 1, characterized in that the first piston-cylinder device (8) is formed of a valve play-take up device which is known per se, that said hydraulic circuit (20) is a pressure fluid circuit for supplying lubricant to the rocker arm shaft and that in a return circuit (19), valve means (20) arranged for excess lubricant, can be set to block the return flow in order to, through elevated pressure in the first piston-cylinder device, bias the first piston (9) towards the exhaust valve (14).

9. Valve mechanism according to claim 3, characterized in that the motion-transmitting means of the second rocker arm is a cam follower (49), which cooperates with a cam element (50) laterally spaced from and on the same cam shaft (6) as the cam element (5) of the first-mentioned cam shaft.

10. Valve mechanism according to claim 2, characterized in that the second cylinder chamber (4) is disposed at a smaller distance from the rocker arm shaft (3) than the first cylinder chamber (9).

11. Valve mechanism according to claim 3, characterized in that the second cylinder chamber (4) is disposed at a smaller distance from the rocker arm shaft (3) than the first cylinder chamber (9).

12. Valve mechanism according to claim 5, characterized in that the first rocker arm (2) has a leverage ratio on the order of 1:1.4–1.6, while the second rocker arm (46) has a leverage ratio on the order of 1:1.7–1.1.

* * * * *